US005125603A

United States Patent [19]

Orasche et al.

[11] Patent Number: 5,125,603

[45] Date of Patent: Jun. 30, 1992

[54] SLIDING CHAIR, SLIDING PLATE AND RIBBED PLATE, RESPECTIVELY, FOR RAILWAY SWITCHES OR RAILWAY CROSSINGS

[75] Inventors: Hermann Orasche; Johann Rieger, both of Zeltweg, Austria; Heinz Steiger, Bern, Switzerland

[73] Assignee: Voest-Alpine Zeltweg Gesellschaft m.b.H., Linz, Austria

[21] Appl. No.: 530,593

[22] Filed: May 30, 1990

[30] Foreign Application Priority Data

Jun. 2, 1989 [AT] Austria ..... 1349/89

[51] Int. Cl.[5] ..... E01B 7/26

[52] U.S. Cl. ..... 246/453; 246/430; 246/444

[58] Field of Search ..... 246/375, 379, 380, 381, 246/382, 385, 386, 392, 415 R, 428, 430, 431, 435 R, 442, 444, 453, 454, 465, 467, 472

[56] References Cited

U.S. PATENT DOCUMENTS

| | | | |
|---|---|---|---|
| 752,517 | 2/1904 | Carter | 246/453 |
| 4,105,175 | 8/1978 | De Spiegeleer | 246/453 X |
| 4,131,255 | 12/1978 | Menia | 246/430 |
| 4,890,804 | 1/1990 | Teramoto et al. | 246/453 |

FOREIGN PATENT DOCUMENTS

| | | | |
|---|---|---|---|
| 0061945 | 10/1982 | European Pat. Off. | 246/380 |
| 0232726 | 8/1987 | European Pat. Off. | 246/453 |
| 2705122 | 8/1977 | Fed. Rep. of Germany . | |
| 2856850 | 7/1980 | Fed. Rep. of Germany | 246/430 |
| 3406726 | 8/1985 | Fed. Rep. of Germany | 246/392 |
| 2398841 | 3/1979 | France | 246/430 |
| 2610649 | 8/1988 | France | 246/430 |
| 2202563 | 9/1988 | United Kingdom | 246/430 |

*Primary Examiner*—Robert J. Spar
*Assistant Examiner*—Scott L. Lowe
*Attorney, Agent, or Firm*—Cushman, Darby & Cushman

[57] ABSTRACT

A railway structure for a sliding chair (2), a sliding plate and a ribbed plate (1), respectively, for railway switches or railway crossings. The structure includes friction-reducing sliding members (4, 5) of synthetic plastic material being releasably mounted within recesses (3) in the sliding chair (2) and the plates, respectively. There are accommodated within each recess (3) at least two sliding members (4, 5) having their side surfaces engaged over the major part of the periphery by inwardly protruding walls or profiles of the edge of the recess, so that there results a safe mounting in position of the sliding members (4, 5). The structure makes the interchange of the sliding members a simple procedure.

9 Claims, 4 Drawing Sheets

VII
19
18
19
3
4
5

VI
VI
3
5
6
4
7
5
6
4
14
19
19

SLIDING CHAIR, SLIDING PLATE AND RIBBED PLATE, RESPECTIVELY, FOR RAILWAY SWITCHES OR RAILWAY CROSSINGS

BACKGROUND OF THE INVENTION

1. Field of the Invention

The invention refers to a sliding chair, a sliding plate and a ribbed plate, respectively, for railway switches or railway crossings, comprising friction-reducing sliding members made of synthetic plastic material the friction-reducing sliding members being releasably mounted within recesses in the sliding chair and the plates, respectively.

2. Description of the Prior Art

In railway switches comprising a deflecting device, the tongue rails rest on sliding chairs and are shiftably supported thereon. In switch constructions that have the frog itself swivelably mounted, different constructions are known in which part of the frog is slidingly supported on a plate member or the whole frog swivelably rests on sliding plates. Swivelable constructional parts are also known in connection with railway crossings, noting that, in all known constructions, a suitable lubrication for sliding support must be provided and, respectively, ease of swivelability on the sliding plates, the sliding chair and the ribbed plates, respectively, in a reliable manner. When lubricating the sliding supports in a usual manner, there results high maintainance costs, because the sliding supports must be supplied with lubricant at regular time intervals. Lubricating oils additionally suffer from the drawback of having varying lubricating properties under the influence of the weather conditions, and the lubricating oils completely lose their lubricating properties in cases of increased contamination. For this reason, it has already been proposed to utilize in place of lubricants sliding members of synthetic plastic material and reduced friction. From DE-OS 27 05 122 there has, for example, become known a railway switch for railway vehicles comprising a deflecting device wherein the tongue rails rest on sliding chairs, noting that friction-reducing sliding members of synthetic plastic material are provided between the parts sliding upon each other. In this known construction, the sliding members of synthetic plastics material were provided on the bottom side of the tongue rails at least within the area of the sliding chairs. Furthermore, it is known to use sliding plates of railway switches coatings consisting of an organic material, noting that such synthetic plastic material shall have a sufficient flexibility, a sufficient impact strength and a sufficient abrasion resistance even at low temperatures. Also, such sliding members of synthetic plastic material are subjected to reduced+wear but still require maintainance work at regular time intervals. For the purpose of facilitating the maintainance work, it has already been proposed in the EP-A 232 726 to mount within a frame, which is removably locked within a recess of the sliding chair, a plurality of sliding elements consisting of self-lubricating material. The self-lubricating material proposed for this construction was graphite-bronze being press-seated within the frame. A construction utilizing graphite-bronze was selected because obviously no type of sliding inserts were found which have sufficient stability and can rapidly and simply be replaced without the use of expensive tools or equipment.

SUMMARY OF THE INVENTION

The invention aims at providing a sliding chair and, respectively, a sliding plate or ribbed plate of the initially mentioned type, which is equipped with friction-reducing sliding members of synthetic plastic material and which simultaneously allows the sliding members to be reliably mounted in position thereby providing a simple possibility to replace damaged sliding members. For solving this task, the construction according to the invention consists, in principle, of at least two sliding members accommodated in each recess, the side surfaces of the sliding members being—for the major part of the periphery of the sliding members—engaged over or, respectively, behind by inwardly protruding walls or, respectively, profiles of the edge of the recess. On account of at least two sliding members being accommodated within each recess and being engaged over or, respectively, engaged behind at their side surfaces over the major part of the periphery of the sliding members by inwardly protruding walls or, respectively, by profiles of the edge of the recess, there is provided, on the one hand, a reliable seat for the sliding members on account of the inwardly protruding walls or, respectively, profiles and there is provided, on the other hand, the possibility of changing the sliding members in a simple manner. For this purpose, it is sufficient to lift and extract one of the sliding members accommodated within the recess, whereupon the other sliding member can, by laterally shifting it, be equally shifted out of that area in which it is engaged over or engaged behind, respectively, by the inwardly protruding walls or profiles. It is thus sufficient to design a small portion of the inner surface of the recess such that it does not engage over the side surfaces of the sliding members and thus provides the possibility of removing the parts via that area in which the side surfaces are not engaged and on account of the side surfaces being engaged over or behind, respectively, by the walls of the recess over the major part of the periphery of the sliding members, a reliable locking effect is obtained in the inserted condition without additional measures, in particular without a separate auxiliary frame. On account of arranging the sliding members within the sliding chair, the sliding plate or the ribbed plate without interpositioning an auxiliary frame, there is obtained a small constructional height which is of particular advantage when using, for example, a space-saving inner bracing of stock rails.

In this case and in a particularly advantageous manner, the arrangement is such that the recesses are of elongated shape and that the separating gap between the sliding members introduced into the recess is arranged in transverse relation to the longer axis of the recess. On account of the recess having an elongated shape, both sliding members to be driven into the recess can in a simple manner be forced into the recess in the direction of its longitudinal axis, so that a great area of the periphery is reliably engaged over or, respectively, engaged behind by inwardly protruding walls or, respectively, profiles of the edge of the recess, noting that only a relatively short area need be designed as an unoccupied area allowing for removal of two sliding members.

The unoccupied area required for the lifting movement and extracting movement, respectively, can be obtained in a simple manner if the recess has an area comprising substantially vertical walls and having a width corresponding to the maximum width of the sliding members as measured in transverse relation to the direction of introducing the sliding members. Sliding members having a dove tail cross section or a trapezoidal cross section can easily be introduced within the area of the essentially vertical walls, noting that driving the members into the area comprising the inwardly protruding walls or, respectively, profiles can be achieved by means of some few strokes in longitudinal direction of the recess. On account of the elasticity of the friction-reducing sliding members consisting of synthetic plastic material, the members are, during the driving-in operation, simultaneously strongly prestressed in the direction toward the bottom of the recess, so that there is simultaneously obtained a reliable anchoring effect. On account of both sliding members being forcibily introduced one after the other, the second forcibly introduced sliding member snaps in under elastic prestress in a direction toward the bottom of the recess, so that a locking action is reliably obtained that prevents outward shifting movement or stepping out of the sliding members.

A particularly simple arrangement results if the sliding members have a substantially trapezoidal cross section and if the base angle of the legs of the trapezoid corresponds to the base angle of the obliquely extending and upwardly inwardly extending walls of the recess. Base angles of the legs of the trapezoid, as measured from the bottom of the recess, have proved particularly valuable if they are in the magnitude of approximately 60°, and such angles ensure that no considerable resistance is encountered when forcibly introducing the sliding members and that the sliding members are reliably fixed in position within the recess.

After having forcibly introduced both sliding members, there remains, of course, between both sliding members a separating gap which advantageously extends in transverse relation to the longer axis of the recess for the purpose of providing a good supporting force against lateral outward shifting movement. The mutually opposing front surfaces of the sliding members at the area of the separating gap thus form a reliable support and counteract, in a reliable manner. For reliably preventing any upward movement of the sliding members, the arrangement is, in this case, preferably such that the separating gap between the sliding members within a recess is arranged within the area of the recess having substantially vertical walls or in proximity of this area. The distance of the separating gap from the unoccupied area as defined by the vertical walls must, of course, be selected so small that the axial compression of the friction-reducing sliding members of synthetic plastic material, when forcibly introducing same with a corresponding tool, for example a hammer, is sufficient to again elastically expand the sliding member forcibly introduced second—after having passed the unoccupied position—to such an extent that its front surface extends into an area in which this second sliding member is already again engaged over by inwardly protruding walls. In this manner, there is obtained a particularly high degree of safety during the locking operation.

For the purpose of removing any contaminations that occur during operation and for counteracting any premature wear of the sliding elements, the arrangement is advantageously such that the sliding members have on their surface grooves extending in a longitudinal direction of the recess or including an acute angle with the longitudinal direction. By arranging these grooves under an acute angle to the longitudinal direction of the recess there results lateral stripping of deposited dirt particles, if any, so that the sliding friction-reducing surface is negligibly subjected to abrasion even in cases of strong contamination. This advantage is obtained in particular if the longitudinal axis of the recesses is oriented in the shifting direction of the shiftable switch part, noting that in these cases—in particular on account of the separating gap extending in essentially transverse relation and in an advantageous manner in essentially orthogonal relation to the longitudinal axis of the recess—shifting forces, if any, introduced into the sliding elements are effectively supported within the area of the supporting gap without having as an effect an upward movement of the sliding members.

A particularly high degree of reduction of the friction and simultaneously a minimum wear can be obtained if in each sliding chair and, respectively, in each sliding plate or ribbed plate there are provided two recesses which are arranged in parallel to each other.

In particular, when using an inner bracing of stock rails, a small constructional height must be intended. When fixing rails or switch parts in position in such a manner, the rails or switch parts are, as a rule, braced by using cotters via leaf spring elements, noting that the sliding chairs comprise corresponding recesses for the cotters. If a thicker design of the sliding chair plates becomes necessary for reliably positioning the cotters, and this for accommodating the sliding members in the recesses engaging over the sliding members, the arrangement is, for compensating this increased constructional height, advantageously selected such that, for the purpose of reducing the constructional height in view of utilizing for positioning rails or switch parts, the ribbed plate or base plate below the sliding chair is stepped down to a smaller plate thickness. As a whole, there can be obtained a reduction of the total constructional height in spite of the sliding members outwardly protruding for a small amount as compared with known constructions.

BRIEF DESCRIPTION OF THE DRAWING

In the following, the invention is explained with reference to examples of embodiments schematically shown in the drawings, wherein further advantages of the inventive construction become clear.

In the drawings.

DETAILED DESCRIPTION OF THE PREFERRED EMBODIMENTS

Figure 1:
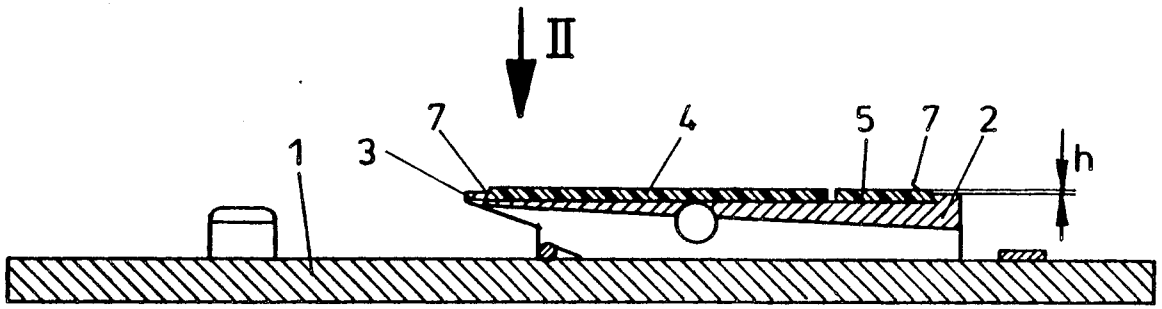
FIG. 1 shows a section of a first embodiment of an inventive ribbed plate comprising a sliding chair having friction-reducing sliding members.
Figure 2:
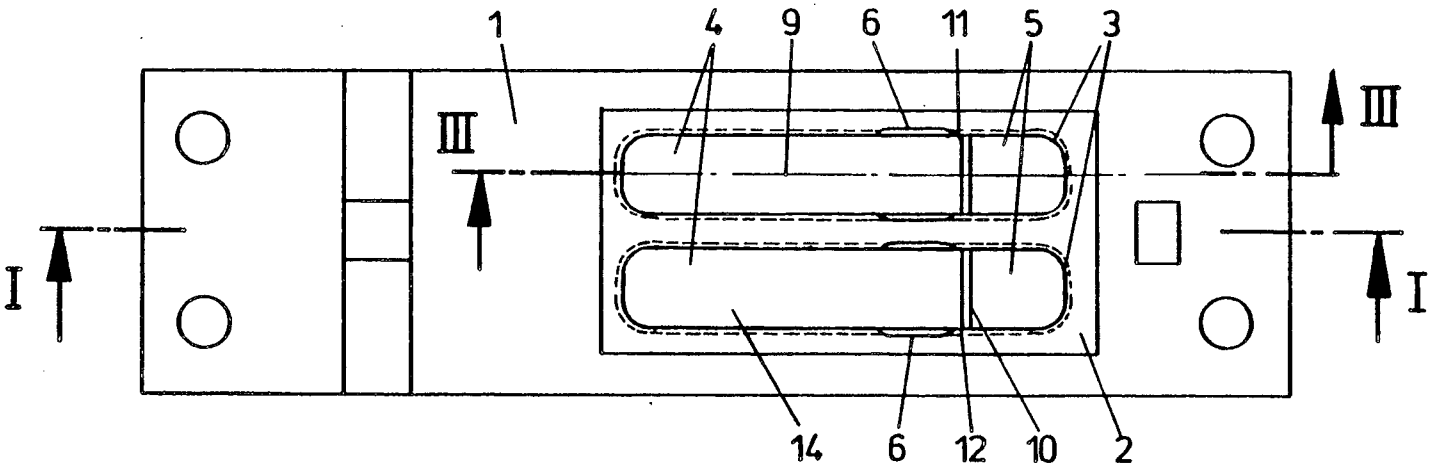
FIG. 2 shows a top plan view in a direction of the arrow II of FIG. 1 of the embodiment according to FIG. 1, noting that FIG. 1 shows a section along line I—I of FIG. 2.
Figure 3:
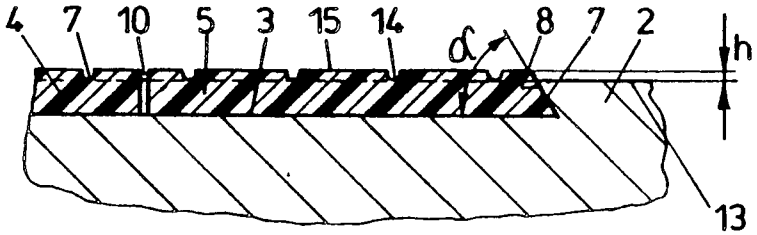
FIG. 3 shows, in an enlarged scale, a partial section along line III—III of FIG. 2 through the sliding members.

In the embodiments according to FIGS. 1 to 3, there is mounted on a ribbed plate 1 a sliding chair 2, noting that two elongated recesses 3 of the sliding chair have disposed therein two self-lubricating, maintainance-free sliding members 4 and 5 of synthetic plastic material. The recesses 3 have over a restricted area an unoccupied portion 6 comprising essentially vertical wall, while the recesses 3 have over the remaining peripheral surface inwardly protruding walls 7 which engage the side surfaces 8 of the sliding members 4 and 5 over the major part of their periphery. In this case, the sliding members 4 and 5 have a substantially trapezoidal cross section as is clearly shown in FIG. 3, noting that the angle between the base, i.e. the bottom surface of the sliding members resting on the bottom of the recess 3, and the inwardly extending legs, which form the side surfaces, essentially corresponds to the walls 7 fo the recesses 3 which inwardly protrude in an upward direction. This angle is designated by $\alpha$ in FIG. 3 and is approximately 60° if the sliding members shall be driven in position in a simple manner and shall be reliably anchored within the recesses 3.

The maintainance-free, self-lubricating sliding members 4 and 5 of synthetic plastic material are, in the embodiment shown, of different length, noting that the length of the individual sliding members 4 and 5 is, considering the location of the unoccupied position 6, selected such that both sliding members 4 and 5 are, after having been driven into the recesses 3 and having been anchored therein, maintained in their position without additional fastening elements. For this purpose, the separating gap 10 between the individual sliding members 4 and 5 extends in essentially transverse relation to the longitudinal direction 9 of the recess 3, is located immediately adjacent that end of the unoccupied position 6 which is designated by 11, said unoccupied position including the essentially vertically extending walls. During assembly the shorter sliding member designated by 5 is first inserted into the recesses, whereupon the longer sliding member 4 is introduced via the unoccupied position 6, said longer sliding member having a low axial compressibility allowing, when driving in the sliding member, entering of the end 12 of the longer sliding members and facing the separating gap to into the area of the unoccupied position 6 and allowing this end 12, after a corresponding expansion in the inserted position, to become engaged over a short area located in proximity of the end 11 of the unoccupied position 6 for the purpose of preventing a rising movement.

The sliding portions 4 and 5, respectively, extend in their mounted position over the surface 13 of the sliding chair for a small height being designated by h in FIGS. 1 and 3. Furthermore, grooves or splines 14 are provided in the upper side of the sliding members, said splines or grooves extending in the embodiment shown in an acute angle relative to the longitudinal axis 9 of the sliding members 4 and 5 and the recess 3 and serving the purpose of removing dirt particles from the surface 15 of the sliding members 4 and 5. The surface is thus protected against abrading influences.

Figure 4:
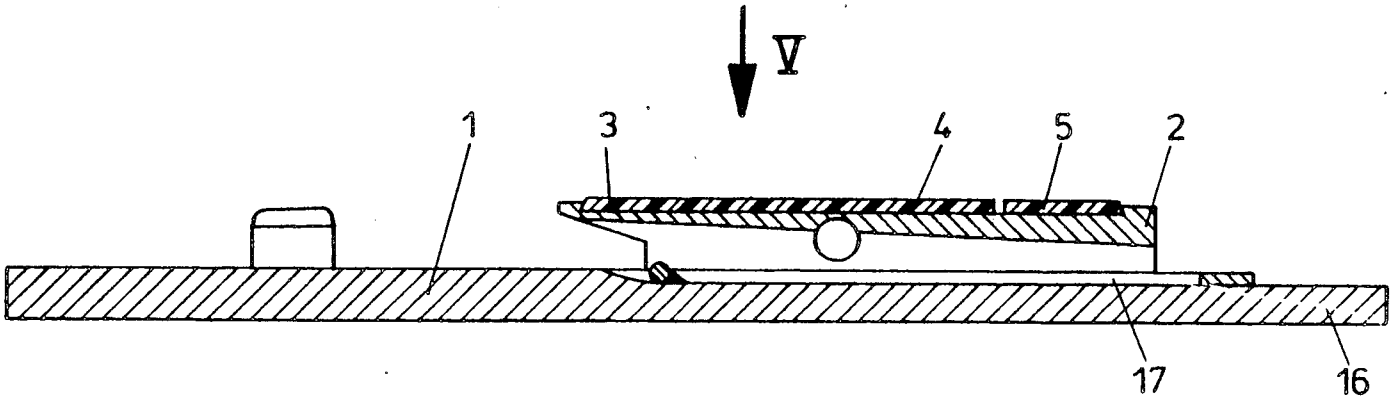
FIG. 4 shows, in a section similar to that of FIG. 1, a modified embodiment.
Figure 5:
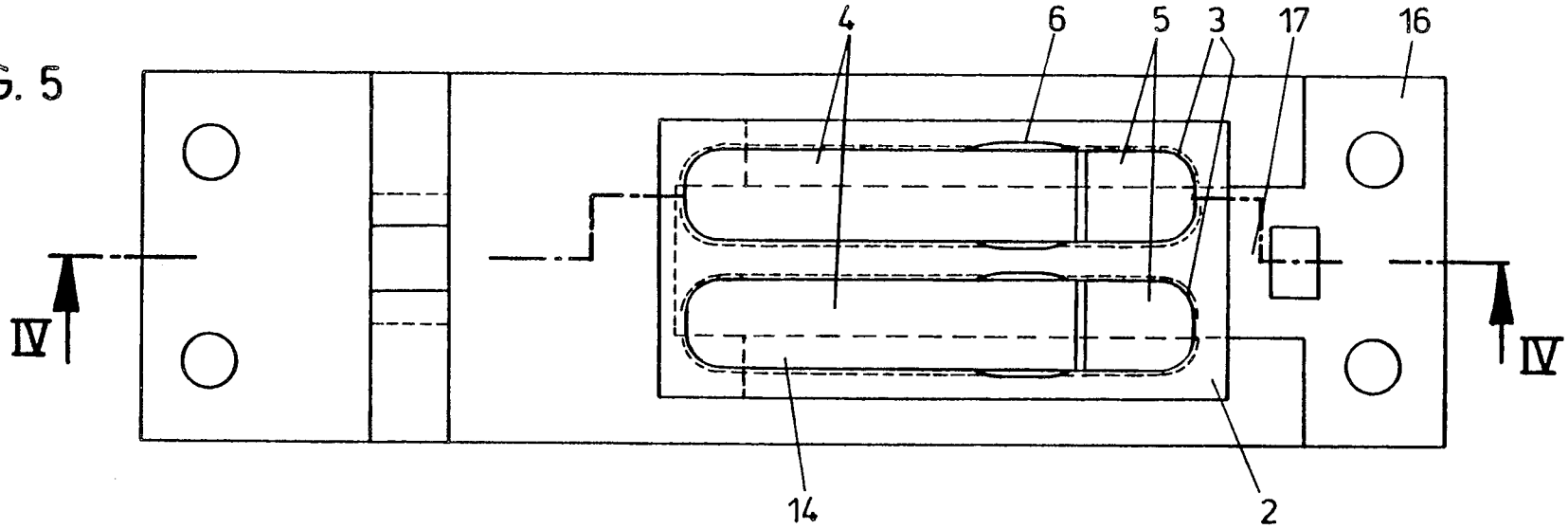
FIG. 5 shows a view of the embodiment according to FIG. 4 in a direction of the arrow V, noting that FIG. 4 shows a section along line IV—IV of FIG. 5.

In the embodiment according to the FIGS. 4 and 5, a sliding chair 2 is again mounted on a ribbed plate 1, noting that sliding members 4 and 5 of synthetic plastic material are again received within elongated recesses 3 of the sliding chair. The sliding members are again maintained in position via the major portion of their periphery by inwardly protruding lateral edges or borders, respectively, of the recesses 3 as is shown in FIG. 3 in an enlarged scale. For the purpose of obtaining a particularly small constructional height, a stepped portion 17 is provided in the base plate 16 of the ribbed plate in the embodiment according to the FIGS. 4 and 5, whereby, as a whole, a low constructional height is obtained, whereby the use of an inner stock rail bracing becomes possible by using extremely low sliding chairs. A stepped portion 17 may be used to increase the thickness of the cover plate of the sliding chair for reliably receiving the sliding members 4 and 5 as well as the cotter for fixing purposes.

On account of the direct arrangement of the sliding members 4 and 5 within recesses 3 of the sliding chair and on account of securing in position the sliding members by inwardly extending wall portions and profiles, respectively, engaging over or, respectively, engaging behind the sliding members, there results, as a whole, a very low constructional height, so that, as already mentioned, a laterally inward elastic mounting of the stock rail becomes possible, noting that two different possibilities are shown in FIGS. 1 to 3 and in FIGS. 4 and 5.

Figure 6:
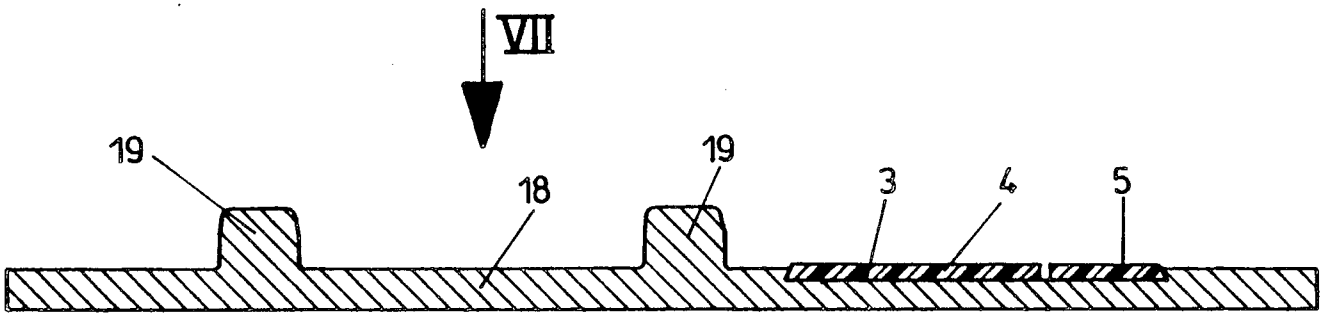
FIG. 6 shows a section through a modified embodiment of an inventive sliding plate.
Figure 7:
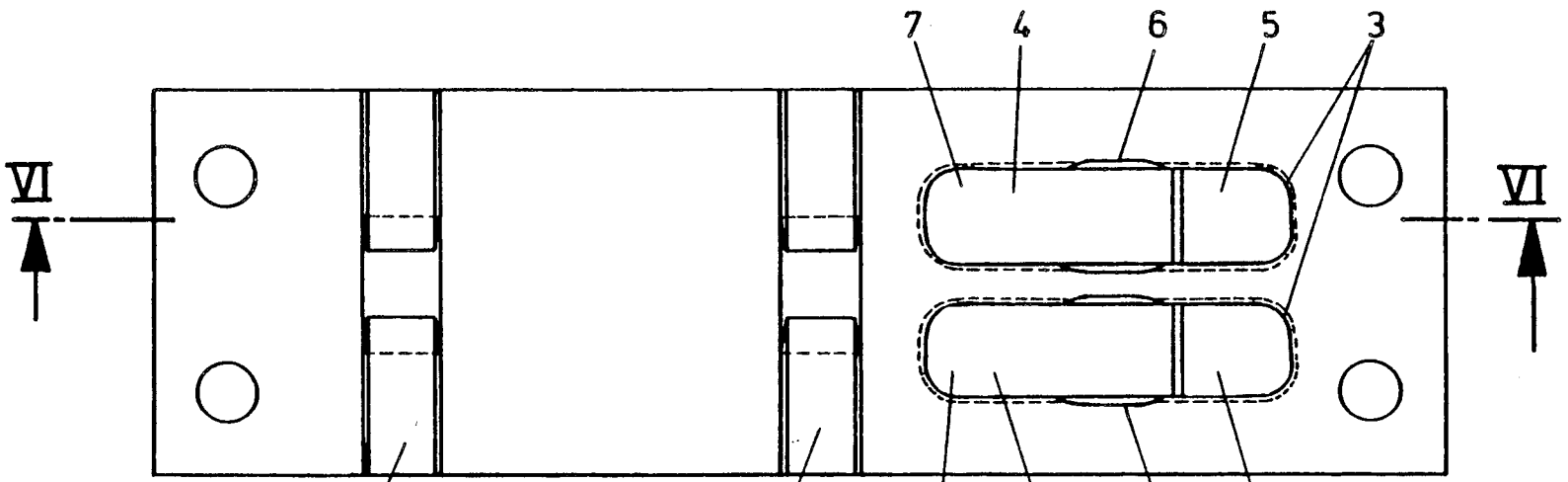
FIG. 7 shows a view of the embodiment according to FIG. 6 in a direction of the arrow VII, noting that FIG. 6 shows a section along line VI—VI of FIG. 7.

In the FIGS. 6 and 7 there is designated by 18 a sliding plate, noting that there are held in position within elongated recesses 3 sliding members 4 and 5 by means of inwardly extending laternal walls of the recesses. The sliding plate 18 is, in this case, provided with ribs 19, noting that also sliding plates without such stop members can be used in a similar manner.

Figure 8:
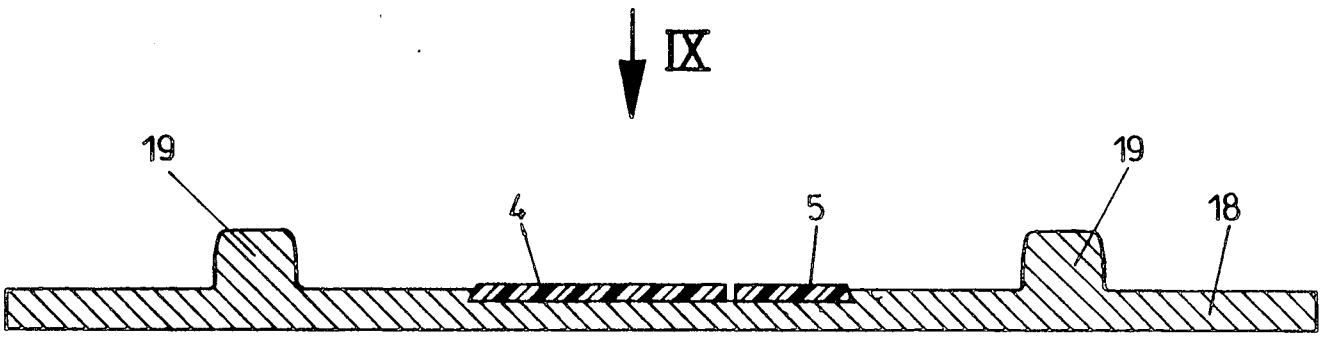
FIG. 8 shows a section through a modified embodiment of a sliding plate according to the invention.
Figure 9:
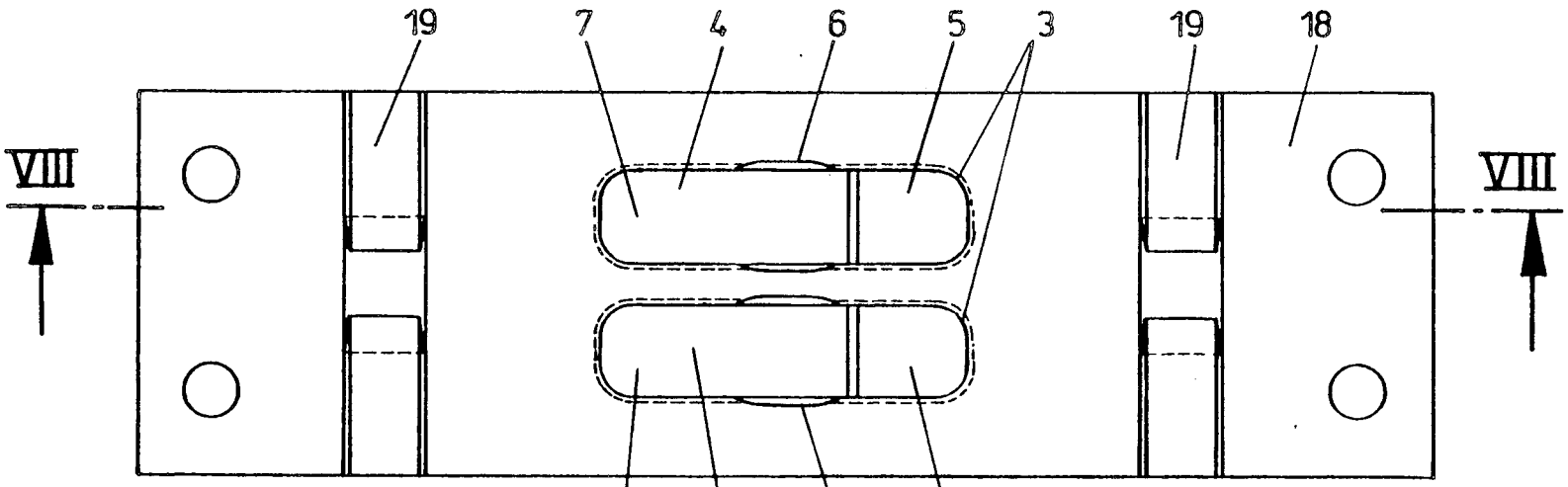
FIG. 9 shows a view of the embodiment according to FIG. 8 in direction of the arrow IX, noting that FIG. 8 shows a section along the line VIII—VIII of FIG. 9.

In FIGS. 8 and 9 there is shown a modified embodiment of a sliding plate 18 which can be utilized in particular for frog constructions comprising movable constructional parts.

The frogs can be frogs comprising movable wing rails or frogs comprising a movable frog tip, noting that the movable parts rest on the sliding members 4 and 5 with the use of a sliding chair or without using a sliding chair.

The design of the side surfaces of the sliding members 4 and, respectively, 5 having a substantially trapezoidal cross section as well as the design of the inwardly extending side walls 7 of the recesses 3 is in all embodiments shown substantially analogous to the design shown in FIG. 3. For the purpose of removing the sliding members 4 and 5 from the recesses 3, there is applied at the separation gap 10 a suitable tool and at first upwardly lifted by lever action the sliding member extending beyond the unoccupied position 6, which is then extracted, whereupon the second sliding member 5 can in a simple manner equally be removed from the recess. Thus, there results the possibility to rapidly interchange the sliding members by means of extremely simple tools because forcibly introducing the sliding members can, for example, be effected by means of a hammer.

Particularly good sliding properties result by arranging two mutually parallel recesses within a ribbed plate or a sliding chair and, respectively, a sliding plate, noting that the longitudinal axis of the elongated recesses 3 extends, as a rule, in a shifting direction of the shiftable switch component or crossing component, respectively.

The trapezoidal shape of the cross section of the sliding members shown in the Figures as well as the side walls of the recesses 3 extending in an inward direction a corresponding angle represents a very simple shape of the cross section which is particularly favorable for introducing and for extracting, respectively, the sliding members. In principle there can, however, be provided other forms of the side walls of the recesses and thus for the side surfaces of the sliding members, which forms allow reliable anchoring of the sliding members within the recesses by means of suitable profiles.

On account of the small height of the recesses 3 and on account of the direct insertion of the sliding members 4 and 5, there can be provided such sliding members in all usual ribbed plates equipped with sliding chairs or in sliding plates or sliding sheets without increasing in practice the total constructional height.

What is claimed is:

1. A railway structure adapted for use in railway switches and railway crossings comprising:

a plurality of recesses formed in said railway structure; and a plurality of friction-reducing sliding members formed of synthetic plastic material removably disposed within said recesses, each of said recesses accommodating at least two of said sliding members and including inwardly protruding walls formed on an inner surface of each recess to hold said sliding members in place, each recess additionally having an elongated shape with a longitudinal axis, said recess holding the sliding members so that a separating gap is left between the sliding members, the separating gap being transverse to the longitudinal axis.

2. A railway structure as claimed in claim 1, wherein said railway structure is a sliding chair and ribbed plate.

3. A railway structure as claimed in claim 1, wherein said railway structure is a sliding plate.

4. A railway structure as claimed in claim 1, 2 or 3, wherein each recess includes a section having only vertical side walls so that said sliding member may be inserted into the recess via said section.

5. A railway structure as claimed in claim 1, 2 or 3, wherein said sliding members have a substantially trapezoidal cross section with a base angle corresponding to a base angle formed between the inwardly protruding walls and a bottom surface of said recess.

6. A railway structure as claimed in claim 4, wherein said separating gap is disposed proximate said section.

7. A railway structure as claimed in claim 1, 2 or 3, wherein said sliding members include grooves disposed on an upper surface thereof.

8. A railway structure as claimed in claim 1, 2 or 3, wherein said longitudinal axis is oriented in a shifting direction of said railway structure.

9. A railway structure as claimed in claim 1, 2 or 3, wherein two recesses are disposed in said railway structure.

* * * * *